US006081965A

United States Patent [19]

Kupfer

[11] Patent Number: 6,081,965

[45] Date of Patent: Jul. 4, 2000

[54] BRAKING MECHANISM FOR THE CASEMENT OF A WINDOW OR DOOR

[75] Inventor: Matthias Kupfer, Bielefeld, Germany

[73] Assignee: SCHÜCO International KG, Bielefeld, Germany

[21] Appl. No.: 09/106,696

[22] Filed: Jun. 29, 1998

[30] Foreign Application Priority Data

Jul. 1, 1997 [DE] Germany ..... 197 27 898

[51] Int. Cl.[7] ..... E05C 17/04; E05F 5/02

[52] U.S. Cl. ..... 16/86 R; 16/82; 292/275

[58] Field of Search ..... 16/49, 82, 85, 16/86 R; 267/120, 196, 201, 205, 207; 188/67, 134–136, 129, 300; 292/275, 305

[56] References Cited

U.S. PATENT DOCUMENTS

| | | | |
|---|---|---|---|
| 1,488,292 | 3/1924 | Schonfield | 292/275 |
| 1,527,981 | 3/1925 | Kimball | 292/275 |
| 1,691,332 | 11/1928 | Beuc | 292/275 |
| 1,818,977 | 8/1931 | Gray | 292/275 |
| 2,845,902 | 8/1958 | Anderson | 188/67 |
| 3,765,053 | 10/1973 | Anweiler | 16/86 C |
| 4,185,539 | 1/1980 | Stratienko | 188/67 |
| 4,190,274 | 2/1980 | Gross et al. | 16/82 |

*Primary Examiner*—Anthony Knight
*Assistant Examiner*—Donald M. Gurley
*Attorney, Agent, or Firm*—Henry M. Feiereisen

[57] ABSTRACT

A braking mechanism is disclosed for installment between the frame and the casement of a door or window including those that are movable about two axes (combined tilting-rotation action) includes a tube that has at the face a guide opening for passage of a piston rod which slideably extends in the tube, with the guide opening being formed by a formed body secured in the tube. The formed body has a conical shape and has braking surface tapering in direction of the guide opening and in engaging contact with a conical braking body which completely surrounds the piston rod and through which the piston rod moves. The braking body is tapered complementary to the braking surfaces of the formed body and is spring-loaded against a stationary abutment. At least one damper element made from elastic material is lodged between the piston and the stationary abutment within the tube.

14 Claims, 2 Drawing Sheets

BRAKING MECHANISM FOR THE CASEMENT OF A WINDOW OR DOOR

BACKGROUND OF THE INVENTION

The present invention relates to a mechanism which controls the braking action of a door or window casement, and in particular to a braking mechanism mounted between the frame and the casement of a window or a door and being of a type having a telescopic tube and a piston rod which is slideably supported in the telescopic tube.

A braking device of this type specifically designed for a skylight casement is disclosed in EP 0 723 058 A2. This braking device is of telescope type and includes a rectangular telescopic tube in which a rectangular flat push rod is slideably guided. The telescopic tube and the flat push rod have free ends which are connected to a coupling link for connection to the frame and the casement of a window.

Neighboring the end of the push rod that is retracted in the telescopic tube is a rectangular cutout for receiving a braking device. This braking device includes two braking jaws having conical surfaces that are facing each other for support upon a wedge lodged in the cutout.

Also mounted within the cutout is a spring in which a pin of the wedge projects and which acts upon the braking jaws, thereby effecting a force-locking connection of the braking jaws with the wedge, with the outer surfaces of the braking jaws being supported by the inner surfaces of the telescopic tube.

An inadvertent disengagement of the push rod and the braking device from the telescopic rod is prevented by forming on the inside of the telescopic tube beads or depressions which extend inwardly from the inner friction surfaces of the telescopic tube. In addition, the flat push rod is formed at a small distance from the rectangular cutout with beads which cooperate with the beads of the telescopic tube during extension stroke of the push rod for limitation of this extension stroke.

As the above described beads form sloping surfaces, it can happen that at great exertion of pressure upon the telescopic assembly, the telescopic tube gets damaged or deformed. This pressure can happen especially when the casement of a window is being pushed open hard so that the telescopic rod and the pushing rod get jammed into each other.

Through the impact stress upon the telescopic assembly in the end position thereof, there is a further danger that the casement itself or the attachment points to the frame and the casement are damaged.

With this known construction, an additional disadvantage is also that due to the normal surface tolerances, a smooth guiding of the braking jaws along the inner surface of the telescope tube and therefore a smooth and even braking action, remains unattainable. Furthermore, the known braking device can only be used on windows with casements that are rotatable around a single axis.

SUMMARY OF THE INVENTION

It is thus an object of the present invention to provide an improved braking device for the casement of windows and doors, obviating the afore-stated drawbacks.

In particular, it is an object of the present invention to provide an improved braking mechanism with improved safety features which permits a smooth and even braking action and which provides for a cushioned and secure end position of the opened window or door so that the braking mechanism can be used as a stop gap for all types of windows and doors especially also those that have casements which are rotatable about two axes such as those with a combined tilting-rotation action.

These objects, and others which will become apparent hereinafter, are attained in accordance with the present invention by providing a braking mechanism which includes a telescopic tube, a piston rod slidably supported in the telescopic tube and carrying a piston, a formed body secured interiorly of the telescopic tube and having an end face formed with a guide opening for allowing passage of the piston rod, with the formed body having conical braking surfaces tapering in direction of the guide opening, a single-piece or multipart conical braking body surrounding the piston rod and continuously loaded by a spring for interaction with the braking surfaces of the formed body, and at least one buffer element made of elastic material and positioned inside the telescopic tube in an area between the piston and the braking body.

The braking force exerted on the piston rod during the extension stroke of the piston rod is generated by the spring and by the frictional engagement between the piston rod, the braking body and the stationary, conical braking surfaces, whereby this braking force is greater than the braking force applied during retraction stroke of the piston rod into the telescopic tube and essentially determined by the spring action.

The so created braking forces can be regulated by the choice of friction coupling of the piston rod and the spring-loaded braking body.

An even release of the friction forces between the spring-loaded braking body and the piston rod is achieved when the piston rod has round cross section.

Of course, the piston rod can also be designed of different cross sectional shapes, for example of oval cross section.

BRIEF DESCRIPTION OF THE DRAWING

The above and other objects, features and advantages of the present invention will now be described in more detail with reference to the accompanying drawing in which according to the present invention.

DETAILED DESCRIPTION OF PREFERRED EMBODIMENTS

Figure 1:
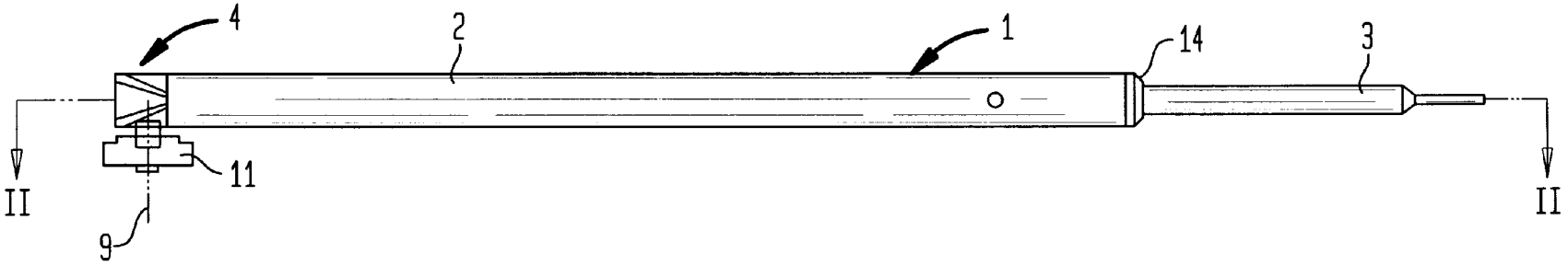
FIG. 1 is an elevational view of a braking mechanism according to the invention.

Throughout all the Figures, same or corresponding elements are generally indicated by same reference numerals.

Figure 2:
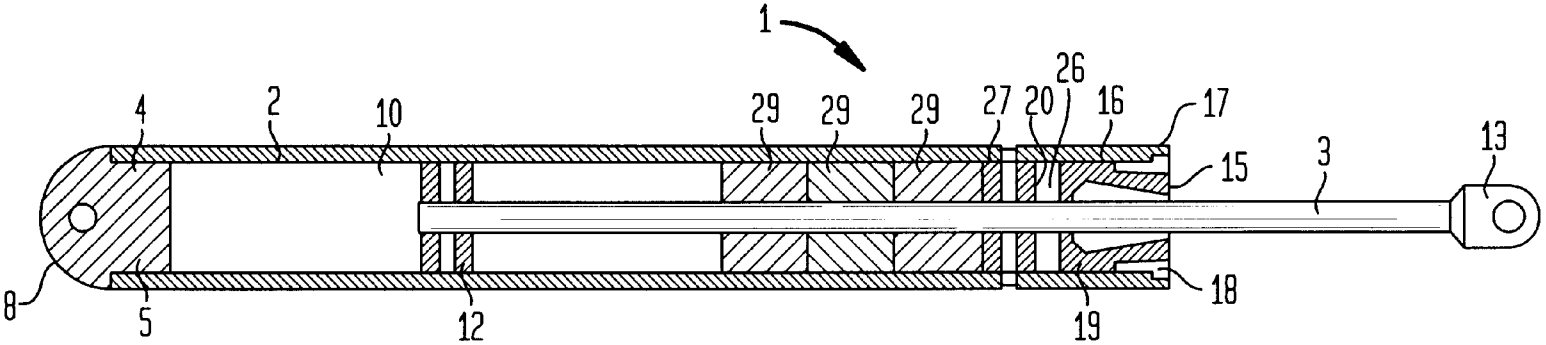
FIG. 2 is a longitudinal section of the braking mechanism, taken along the line II—II in FIG. 1.
Figure 3:
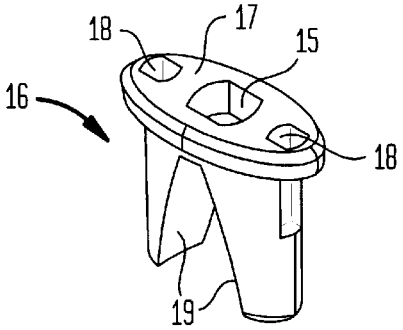
FIG. 3 is a perspective view of a formed body for formation of the guide opening of the telescopic tube for the piston rod.

Turning now to the drawing, and in particular to FIG. 1, there is shown the braking device 1 according to the invention, for attachment between the frame and the casement of a door or a window. The braking device 1 includes a telescopic tube 2 and a piston rod 3. As shown in FIGS. 1 and 2, the cross section of the telescopic tube 2 can be shaped elliptical or oval.

Figure 7:
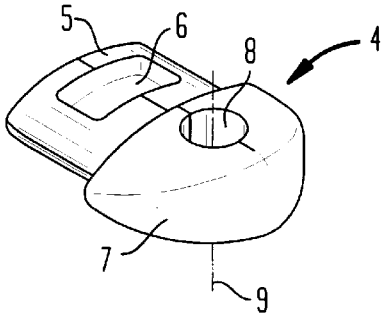
FIG. 7 is a perspective view of a head piece for closing the formed body distant end of the telescopic tube.

The telescopic tube 2 has one end closed by a head piece 4 which is shown in FIG. 7 by way of a perspective view and includes an attachment piece 5 for engagement into the telescopic tube 2, and a protrusion 7 which is connected to the attachment piece 5. The attachment piece 5 is anchored by a tab which is punched out from the telescopic tube 2 and is in engagement with a recess 6 formed in the attachment piece 5. The protrusion 7 of the head piece 4 projects outwards from the axial end of the telescopic tube 2 and has a bore 8 which is defined by an axis 9 extending perpendicular to the longitudinal axis 10 of the telescopic tube 2. A fastening element is guided through the bore 8 for articulation of a fitting 11 which is rotatable about the pivot axis 9 and serves as the attachment point of the end of the braking mechanism I to be mounted to the frame or the casement.

The attachment piece 5 of the head piece 4 which is fitted into the telescopic tube 2 has an oval cross section which corresponds to the oval inner cross section of the telescopic tube.

Attached to the piston rod 3 is a piston 12 which is slideably supported at relatively great clearance within the telescopic tube 2 and is made from metal, preferably from light metal or plastic.

At its free extended end, the piston rod 3 is equipped with a connector plate 13 for articulation of the piston rod 3 to a fitting by which the end of the piston rod 3 is attached to the frame or the casement of the door or window.

The piston rod 3 traverses the end face 14 of the telescopic tube 2 via a guide opening 15 created by an insert or formed body 16 which is fitted into the open end of the telescopic tube 2. The formed body 16 may be made from pressure-cast aluminum, or pressure-cast zinc or from plastic and is attached to the telescopic tube 2 by a fastening flange 17 which bears upon the end face 14 of the telescopic tube 2. The outer shape of this fastening flange 17 complements the outer shape of the end face 14 of the telescopic tube 2 so that the end face 14 of the telescopic tube 2 is entirely covered. The formed body 16 is further provided with recesses 18 for driving in fastening elements to thereby secure the formed body 16 to the telescopic tube 2.

The formed body 16 has conically shaped braking surfaces 19 which taper towards the guide opening 15 and interact with a braking body 20 which has a central channel 21 for passage of the piston rod 3. This braking body 20 is conically shaped and has an outer contour which corresponds to the contour of the braking surfaces 19 of the formed body 16.

Figure 4:
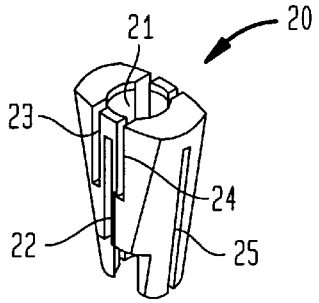
FIG. 4 is a perspective view of braking body for cooperation with the braking surfaces of the formed body.
Figure 5:
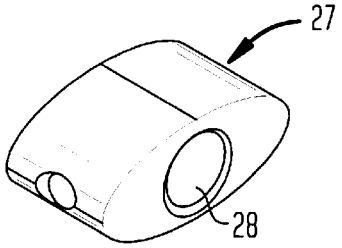
FIG. 5 is a perspective view of a stationary abutment.

As shown in FIG. 4, the braking body 20 is formed with longitudinally overlapping slits 22, 23, 24, 25 so that the braking body 20 is able to adapt to the piston rod 3 during operation even when the piston rod 3 is subject to wear, and is capable to apply a braking force onto the piston rod 3 in particular when the piston rod 3 travels out of the telescopic tube 2 and cooperates with the conically shaped braking surfaces 19.

In the illustration of FIG. 4, the braking body 20 is of single-piece configuration; however the braking body 20 can also be made from multiple parts.

The braking body 20 is preferably made from a plastic material which exhibits a high friction value as compared to the piston rod 3 which is made from metal, preferably steel.

The braking body 20 is constantly loaded by a spring 26, which, as shown in FIG. 2, is designed as a cylindrical helical spring. The spring 26 has one braking body distant end which bears upon an abutment 27 securely fixed in the telescopic tube 2 and immovable via an inwardly directed depression 31 of the telescopic tube 2. The abutment 27 may be made from aluminum and has a center bore for passage of the piston rod 3.

The abutment 27 has an oval-shaped configuration to complement the inner contour of the telescopic tube 2.

The configuration of the abutment 27 corresponds largely to the configuration of the piston 12, with the exception that the piston 12 is slideably supported within the telescopic tube 2.

In the embodiment as shown in FIG. 2, three damper or buffer elements 29 are located between the abutment 27 and the piston 12 for effecting an attenuation of the impact force when the piston 12 is moving under considerable force in the direction of the abutment 27.

Figure 6:
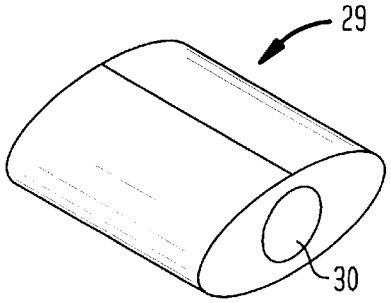
FIG. 6 is a perspective view of a damper element.

These elastic buffer elements 29 are shown in FIG. 6 and are formed with a central channel 30 through which the piston rod 3 extends. The buffer elements 29 can be made from foamed plastic or rubber, with the outer shape of the buffer elements 29 corresponding to the inner shape of the telescopic tube 2, so that the buffer elements 29 are able to fill the rod-free space within the telescopic tube 2 along their length.

While the invention has been illustrated and described as embodied in a braking mechanism for the casement of a window or door, it is not intended to be limited to the details shown since various modifications and structural changes may be made without departing in any way from the spirit of the present invention.

What is claimed as new and desired to be protected by letters patent is set forth in the appended claims:

1. A braking mechanism for a casement of a window or a door, comprising:

a tube;

a piston rod extending from one end of the tube and slidably supported in the tube and carrying a piston;

a formed body secured interiorly of the tube at the one end and having a guide opening extending therethrough allowing passage of the piston rod, said formed body having an inner conical braking surfaces tapering in direction of the tube one end;

a conical braking body surrounding the piston rod in frictional engagement, and continuously loaded by a spring, said braking body interacts with the braking surfaces of the formed body during an extension stroke of the piston rod from the tube one end;

a stationary abutment secured within the tube and positioned at a distance from the formed body, said abutment supporting one end of the spring that loads the braking body, and at least one buffer element made of elastic material and positioned inside the tube in an area between the piston and the braking body.

2. The braking mechanism of claim 1, wherein the telescopic tube has an end face, said formed body including an attachment flange covering the end face of the tube.

3. The braking mechanism of claim 1 wherein the braking body is of single-piece configuration and is formed with overlapping slits.

4. The braking mechanism of claim 1 wherein the braking body is composed of multiple parts.

5. The braking mechanism of claim 1 wherein the conical contour of the brake body complements the conical contour of the braking surfaces, said braking body being formed with a passageway for traversal of the piston rod.

6. The braking mechanism of claim 1, wherein said abutment having one side supporting one end of the spring that loads the braking body and another piston-proximate side supporting the buffer element.

7. The braking mechanism of claim 1, including several buffer elements of pulvinated configuration.

8. The braking mechanism of claim 1 wherein the buffer element is made of foam material.

9. The braking mechanism of claim 1 wherein the buffer element is made of rubber.

10. The braking mechanism of claim 1 wherein the buffer element encloses the piston rod and is so configured as to fill out a rod-free inner space of the tube between the piston rod and the abutment.

11. The braking mechanism of claim 1 wherein the tube has a oval-shaped configuration.

12. The braking mechanism of claim 1 wherein the piston rod is round.

13. The braking mechanism of claim 1 wherein the piston rod is oval.

14. The braking mechanism of claim 1 wherein a braking force is applied on the piston rod, during an extension stroke of the piston rod, by the spring and a frictional engagement between piston rod, the braking body and the stationary conical shaped braking surfaces, with the braking force exceeding a braking force applied by the spring during a retraction stroke of the piston rod.

* * * * *